US005094042A

United States Patent [19]

Freborg

[11] Patent Number: 5,094,042

[45] Date of Patent: Mar. 10, 1992

[54] ASPHALT COMPOSITION RIDGE COVER AND METHOD OF FORMING

[76] Inventor: Ben Freborg, 3936 Madison Rd., Funtridge, Calif. 91011

[21] Appl. No.: 638,781

[22] Filed: Jan. 8, 1991

[51] Int. Cl.[5] ..... E04D 1/30

[52] U.S. Cl. ..... 52/57; 52/748

[58] Field of Search ..... 52/57, 276, 278, 741, 52/748, 526, 518, 558, 559, 528; 156/226, 227, 204

[56] References Cited

U.S. PATENT DOCUMENTS

| | | |
|---|---|---|
| 420,707 | 2/1890 | Toner et al. . |
| 899,022 | 9/1908 | Benson . |
| 1,107,568 | 8/1914 | Bamberger et al. . |
| 1,362,755 | 12/1920 | Statler . |
| 1,372,208 | 3/1921 | Statler . |
| 1,410,299 | 3/1922 | Harshberger . |
| 1,435,623 | 11/1922 | Saxe . |
| 1,471,396 | 8/1923 | Griswold . |
| 1,547,498 | 7/1925 | Jordan . |
| 1,596,272 | 8/1926 | Jordan . |
| 1,619,600 | 3/1927 | Cumfer . |
| 1,975,986 | 10/1934 | Straub . |
| 1,994,643 | 3/1935 | Harshberger . |
| 2,059,233 | 11/1936 | Harshberger . |
| 2,089,490 | 8/1937 | Kuhn . |
| 2,110,258 | 3/1938 | Blank . |
| 2,192,810 | 3/1940 | Angier . |
| 2,253,753 | 8/1941 | Black . |
| 2,305,008 | 12/1942 | Howard . |
| 3,913,294 | 10/1975 | Freiborg . |
| 4,187,650 | 2/1980 | Poplin . |
| 4,226,069 | 10/1980 | Hinds . |
| 4,322,928 | 4/1982 | Freiborg . |
| 4,404,783 | 9/1983 | Freiborg . |
| 4,434,589 | 3/1984 | Freiborg . |
| 4,439,995 | 4/1984 | Freiborg . |
| 4,580,389 | 4/1986 | Freiborg . |
| 4,593,512 | 6/1986 | Funaki . |
| 4,672,790 | 6/1990 | Freiborg . |
| 4,768,318 | 9/1988 | Freiborg . |

FOREIGN PATENT DOCUMENTS

| | | |
|---|---|---|
| 506333 | 8/1920 | France . |
| 744271 | 7/1954 | United Kingdom . |

*Primary Examiner*—John E. Murtagh

*Attorney, Agent, or Firm*—Blakely, Sokoloff, Taylor & Zafman

[57] ABSTRACT

A ridge cover used to shingle houses, that gives a roof the appearance of a wood shake shingle. The cover is constructed from a rectangular sheet of asphalt composition which has a plurality of folding tabs. The tabs are arranged such that when the tabs are folded from the side, the resulting cover has a thickened portion on one end of the cover.

21 Claims, 3 Drawing Sheets

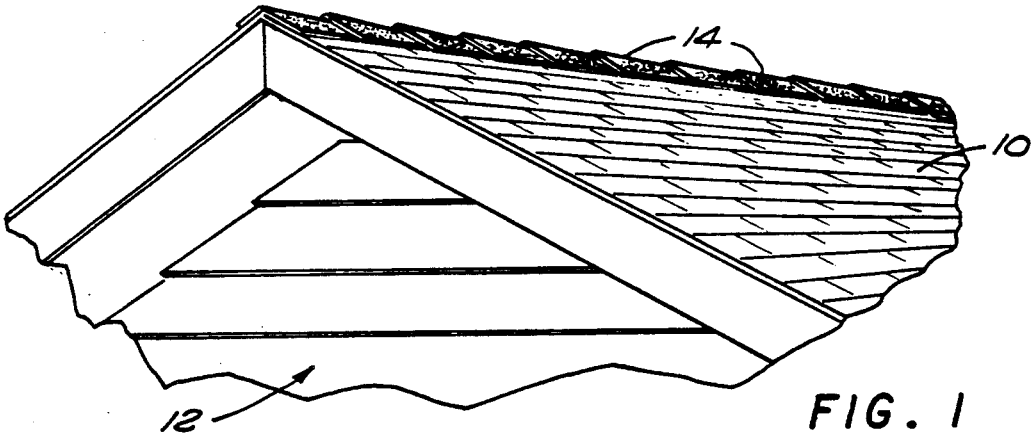
FIG. 1
FIG. 3
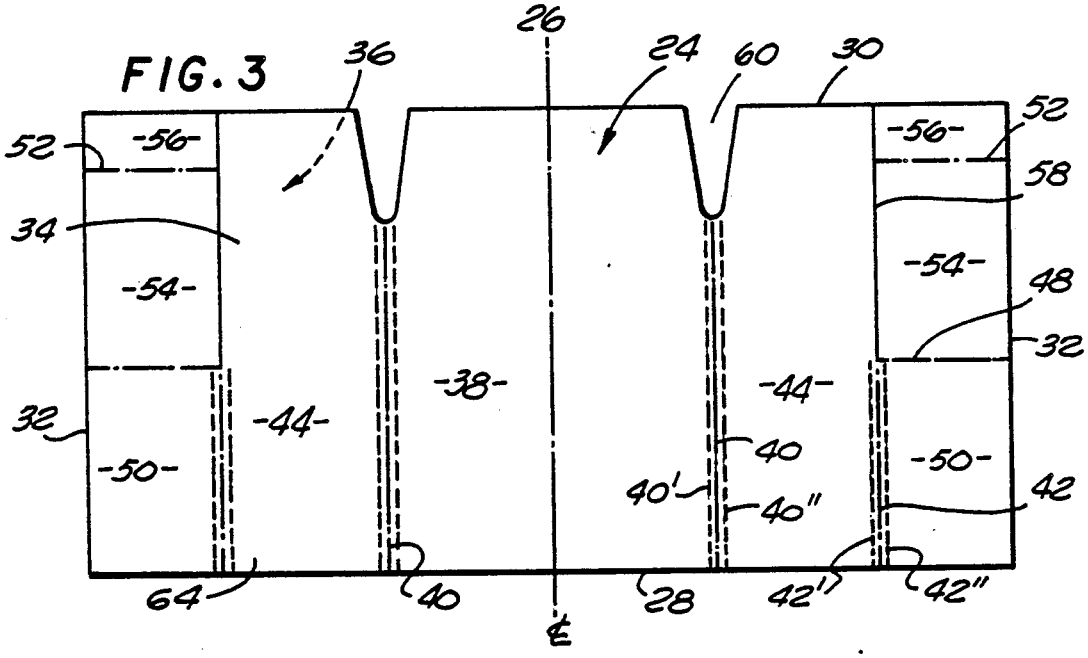
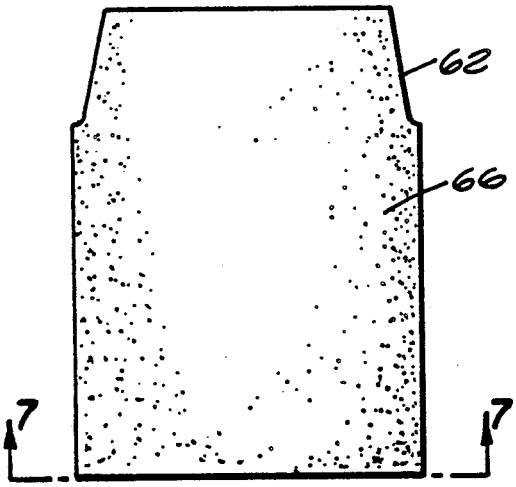
FIG. 5
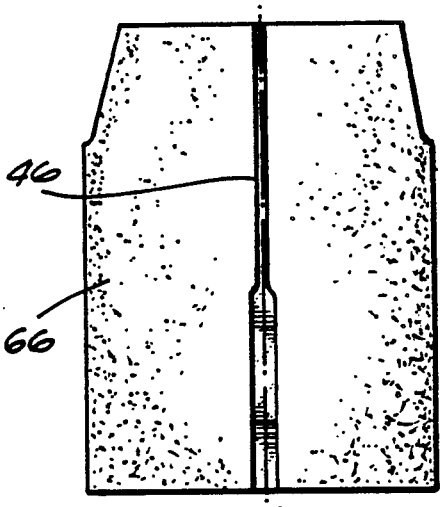
FIG. 4

FIG. 6
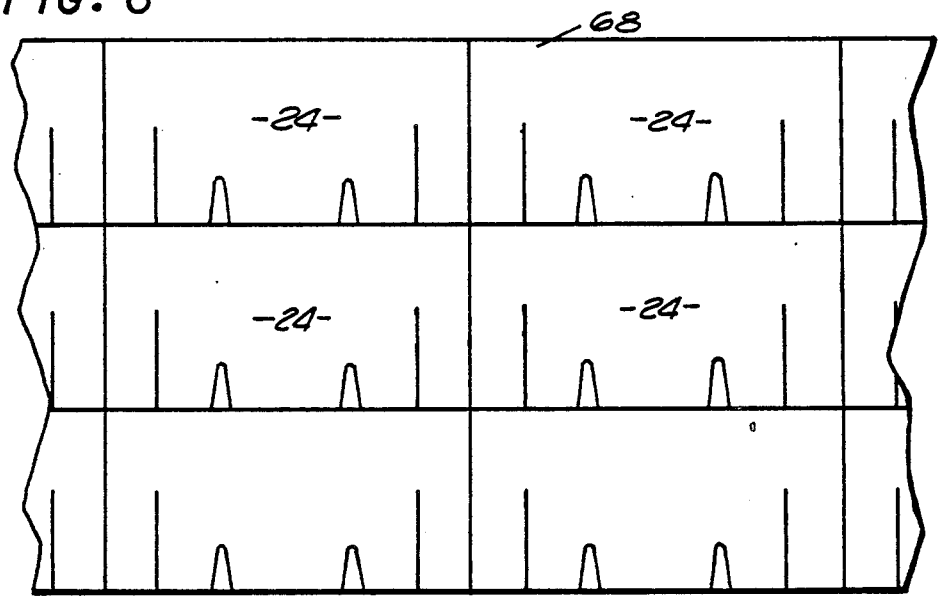
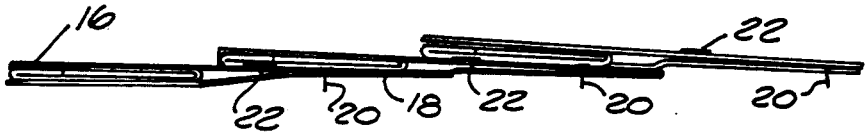
FIG. 2
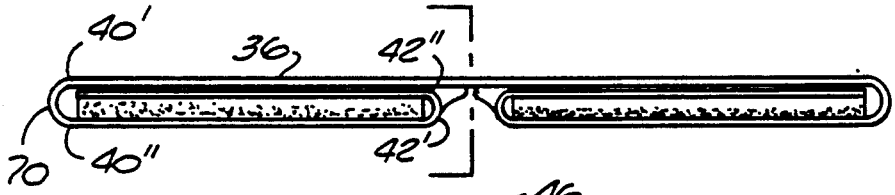
FIG. 7
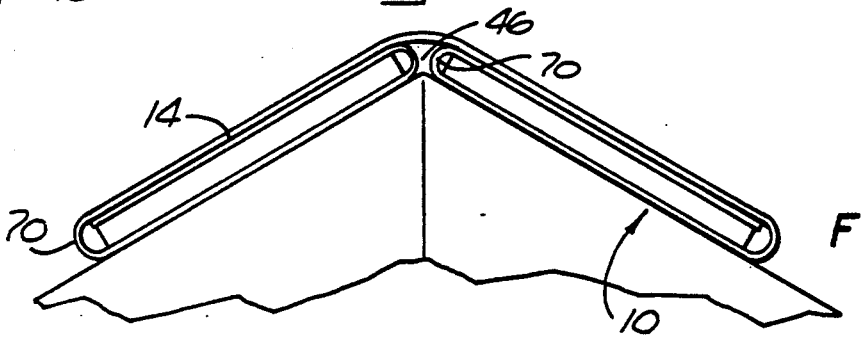
FIG. 8
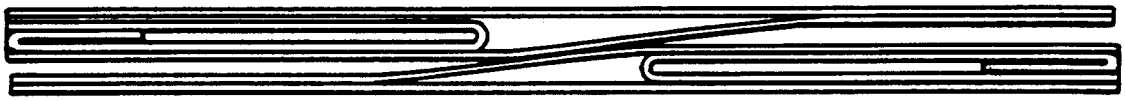
FIG. 9

ASPHALT COMPOSITION RIDGE COVER AND METHOD OF FORMING

FIELD OF INVENTION

This invention relates to asphalt composition ridge covers that are typically attached to the roofs of residential buildings.

BACKGROUND OF THE INVENTION

Ridge covers are used to shingle the ridge of a roof. It has become increasing popular to shingle the roof ridge, such that it has the appearance of a shake shingle roof. The present inventor had devised a ridge cover, described in U. S. Pat. No. 4,434,589, with a varying thickness that when installed, produced the shake shingle effect. The change in thickness was created by taking a single flat piece of asphalt composition and folding multiple tabs until the desired thickness was obtained. As shown in FIG. 5 of the '589 patent, the individual pieces were cut out from a roll of asphalt composition into the desired shapes. The cutting of these irregular shaped pieces produced an excess amount of waste asphalt material, that is both costly and difficult to dispose.

U.S. Patent No. 3,913,294 by the same inventor, discloses a ridge cover with a thickened portion that is formed by folding the middle portion of the cover. The '294 covers have to be packed in corrugated boxes which are bulky and costly. The covers can not be stacked on pallets because adjacent covers are supported by the thickened middle portion, wherein the thin portions tend to bend or bow. Therefore what is needed is a ridge cover of varying thickness that can be efficiently stacked and cut from a roll with minimal waste.

SUMMARY OF INVENTION

The present invention is a ridge cover constructed from a rectangular sheet of asphalt composition which has a plurality of folding tabs. The tabs are arranged such that when the tabs are folded from the side, the resulting cover has a thickened portion on one end of the cover. Because the covers are rectangular and thicker at one end, the covers can be stacked by rotating each adjacent cover 180 degrees, such that the thick portion of one cover is contiguous to the thin portion of an adjacent cover. The rectangular shape of the unfolded asphalt sheet allows individual sheets to be cut from a roll with minimal waste.

Therefore it is an object of this invention to provide a ridge cover of varying thickness that produces little waste when cut from a roll.

It is also an object of this invention to provide a ridge cover of varying thickness that can be easily stacked and shipped.

BRIEF DESCRIPTION OF THE DRAWINGS

The objects and advantages of this invention will become more apparent to those skilled in the art after reviewing the following detailed description and drawings, wherein:

FIG. 1 is a perspective view of a portion of a house, with the ridge covers of the present invention installed on the ridge of the house;

FIG. 2 is a side view of a roof, showing the ridge covers attached to the house in overlapping fashion;

FIG. 3 is a bottom view of a single sheet of asphalt composition;

FIG. 4 is a bottom view of a folded ridge cover;

FIG. 5 is a top view of FIG. 4;

FIG. 6 is a top view of a roll of asphalt composition showing the cutting lines of each individual sheet;

FIG. 7 is a front view of FIG. 5, taken at line 7—7;

FIG. 8 is a front view of a bent ridge cover attached to the roof of a house;

FIG. 9 is a cross-sectional side view, showing two folded ridge covers stacked on top of each other;

DETAILED DESCRIPTION OF THE INVENTION

Figure 10A:
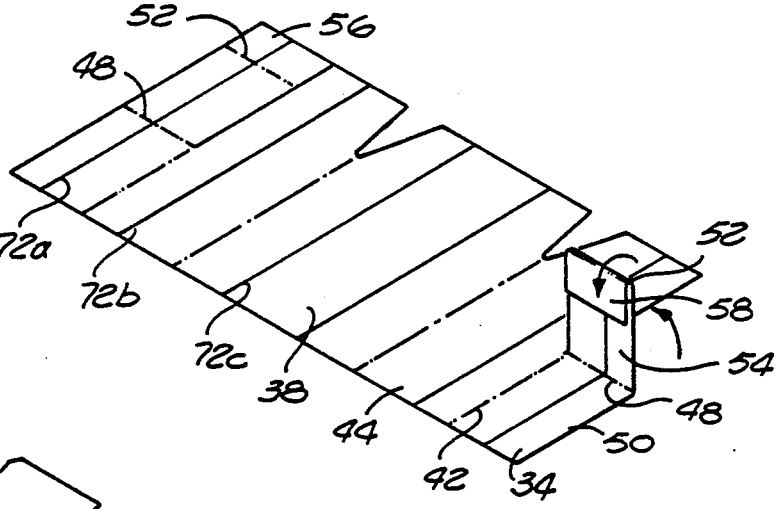
FIG. 10*a* shows the first fold made to the ridge cover.
Figure 10B:
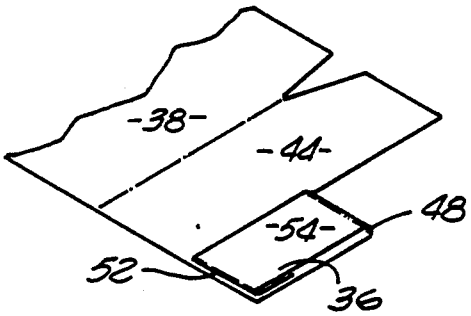
FIG. 10*b* shows the second fold made to the ridge cover.

Referring to the drawings more particularly by reference numbers, number 10 in FIG. 1 is the roof 10 of a house 12, with a plurality of ridge covers 14 installed on the ridge of the house 12. It is to be understood that the phrase ridge cover, as used herein, is used in the broad sense to include hip covers and the like, and is used merely as a convenient phrase for identifying all such covers 14. FIG. 2 more clearly shows the installation of the covers 14. When installed the thickened portion 16 of the covers 14 are placed over the back portion 18 of the adjacent cover, so as to conceal the nails 20 used to attach the covers 14 to the roof 10. The resulting structure creates an appearance similar to a wood shake shingle roof. The folded covers 14 are typically 12" long and 9" wide. An adhesive strip 22 may be applied to the cover on the back portion 18, to attach the thickened portion 16 of the overlaying cover 14 with the back portion 18 of the underlying cover 14.

FIG. 3 shows the preferred embodiment of an unfolded ridge cover 14. The ridge cover 14 starts from a single sheet 24 of asphalt composition that is rectangular in shape and has a centerline 26 along the width of the sheet 24. The sheet 24 has a first end 28, a second end 30, a pair of edges 32, a first face 34 and a second face 36. The sheet 24 has a center portion 38 defined as the area between a pair of first fold lines 40. Between the first fold lines 40 and a pair of second fold line 42 are a pair of first edge tabs 44. The distance between the first 40 and second 42 fold lines is slightly less than the distance from the centerline 26 to one of the first fold lines 30. When the first edge tabs 44 are folded over, the end of the first edge tabs 44 (the second fold lines 42) do not reach the centerline. As shown in FIG. 4, this creates a breakgap 46 that allows the ridge cover 14 to be bent more easily onto the roof. Between the second fold lines 42 and the sheet edges 30, and between the first end 28 and a pair of third fold lines 48 are a pair of second edge tabs 50. From the third fold lines 48 and a pair of fourth fold lines 52 is a pair of third edge tabs 54. Extending from the fourth fold lines to the second end 30 are a pair of fourth edge tabs 56. The length of the third edge tabs 54 should be such that when the third edge tabs are folded onto the second edge tabs 50 the end of the third edge tabs defined by line 52, does not exceed the first end 28. Thus, when the sheet 24 is folded, the folded tabs 54 and 56 do not stick out of the cover 14. To facilitate folding the third and fourth edge tabs onto the second edge tabs 50, a pair of slits 58 are cut from the second end 30 to the third fold lines 48, along the second fold lines 42. A pair of notches 60 are cut into the sheet 24 from the second end 30 along the first fold lines 40. When the cover 14 is folded, the notches 60 create a taper 62 on the back end 18, as shown in FIG. 5. The taper 62 is produced so that when the covers 14 are installed the back end 18 does not stick out from under the thickened portion 16 of the overlapping cover.

The sheet 24 typically comprises a layer of asphalt saturated felt 64, which has a layer of rock granules 66 applied to the second face, wherein the rock granules 66 form the outer surface of the folded cover 14 as shown in FIGS. 4 and 5. The individual sheets 24 are initially part of a roll 68 a portion of which is shown in FIG. 5. The roll 68 is cut into rectangular sheets 24. In addition, the slits 58 are cut and the notches 60 punched out to produce the desired form. The rectangular shape eliminates the waste that is produced with other forms such as the cover disclosed in '589. This is important for large production runs, wherein even the smallest pieces of excess material can cumulate into large amounts of costly scrap and hard to dispose waste.

The fold lines are formed by passing the still hot asphalt felt under rollers (not shown) that depress the felt 64. It has been found that when the cover 14 is folded, the layer of granules 66 and felt 64 tend to split, crack and separate. As a result, the visible edges formed by these folds appear ragged and broken. To reduce the occurrence of this defect, a relief radius 70 can be formed in the folded cover 14, see FIG. 7, by replacing the first 40 fold lines with a pair of spaced apart first fold lines indicated in FIG. 3 as 40' and 40''. The second fold line 42 may also be replaced with a pair of spaced apart second fold lines 42' and 42''. The fold about the pair of second fold lines 42' and 42'' can be seen in FIG. 4, with the increased breakgap 46 toward the first end 28. As stated earlier, the breakgap 46 allows the cover 14 to be bent and installed onto the roof 60 as shown in FIG. 8.

FIG. 9 shows one of the more attractive features of the present invention, the ability to efficiently stack the covers 14 for packing and shipping. By constructing the ridge covers 14 with a thickened portion 16 at the first end 28, the covers 14 can be stacked on top of each other by rotating each cover 14 180 degrees as shown in FIG. 9. This arrangement not only maximizes space, but also prevents the covers from bending or bowing during shipping, where temperatures can exceed the softening temperature (approximately 90° F.) of the asphalt felt 64. The cover 14 can then be stacked on pallets and easily transported to a job site.

Figure 10C:
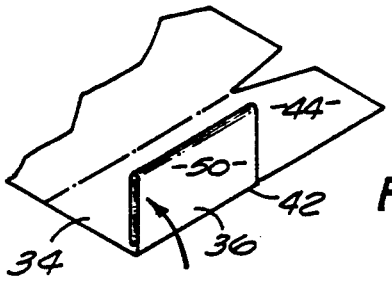
FIG. 10*c* shows the ridge cover going through the third fold.
Figure 10D:
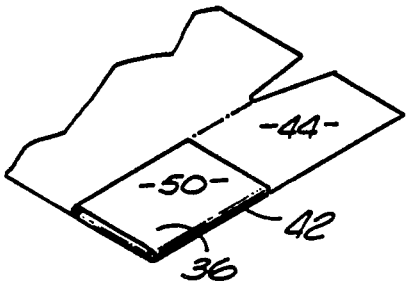
FIG. 10*d* shows the third fold made to the ridge cover.
Figure 10E:
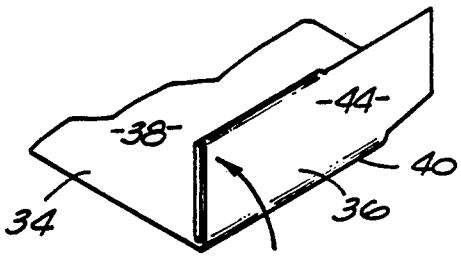
FIG. 10*e* shows the ridge cover going through the final fold.
Figure 10F:
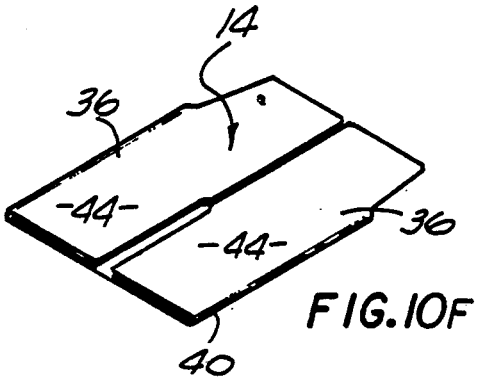
FIG. 10*f* shows the final fold made to the ridge cover.

FIGS. 10*a–f* show how the sheet 24 is folded into a ridge cover 14. First, the fourth edge tabs 56 are folded about the fourth fold line 52, wherein the first face 34 of the fourth edge tabs 56 faces the first face 34 of the third edge tab 54. The folded fourth edge tabs 56 and third edge tabs 54 are then folded about the third fold lines 48, such that the second face 36 of the fourth edge tabs 56 and first face 34 of the third edge tabs 54 faces the first face 34 of the second edge tabs 50. The second edge tabs 50 and folded third edge tabs 54 are then folded about the second fold lines 42 onto the first edge tabs 44 as shown in FIGS. 10*c–d*. In this position, the second face 36 of the third edge tab 54 faces the first face 34 of the first edge tabs 44. In the final step, the first edge tabs 44 and folded second edge tabs 50 are folded about the first fold line 40 onto the center portion 38, wherein the second face 36 of the second edge tabs 50 and the first face 34 of the first edge tabs 44, faces the first face 34 of the center portion 38.

In the preferred embodiment beads of adhesive 72 are applied to the first face 34 as shown in FIG. 10*a*. The adhesive 72 act as a means of attaching the faces of the tabs that face each other as described hereinafter. The first face 34 of the fourth edge tabs 56 are attached to said first face 34 of the third edge tabs 54, and the second face 36 of the fourth edge tabs 58 and first face 34 of the third edge tabs 54 are attached to the first face 34 of the second edge tabs 50, by a first pair of adhesive lines 72*a* running essentially parallel with the second fold line 42, approximately at the center of the second 50, third 54 and fourth 58 edge tabs. The second face 36 of the third edge tabs 54 are attached to the first face 34 of the first edge tabs 44 by a second pair of adhesive lines 72*b* running essentially parallel with the first fold line 40, approximately at the center of the first edge tabs 44. The second face 36 of the second edge tabs 44 and the first face 34 of the first edge tabs 44 are attached to the first face 34 of the center portion 38 by a third pair of adhesive lines 72*c*, running essentially parallel with the centerline 26 approximately one-half the distance between the centerline 26 and said first fold line 40. The adhesive 72 insures that the folded tabs don't "spring" back to the flat position.

Figure 11:
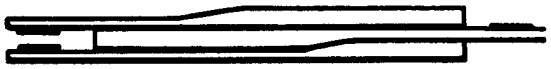
FIG. 11 is a side view of an alternate mode of stacking ridge covers having a tacking adhesive.

When the back adhesive strip 22 is added to the cover to facilitate installation, an alternate method of stacking the cover 14 can be performed as shown in FIG. 11.

As alternate embodiments, the fourth 56, or the third 54 and fourth 56 edge tabs could be eliminated. If the third 54 and fourth 56 edge tabs are eliminated, the first edge tabs 44 could end at the third fold line 48, wherein the thickened portion 16 is formed by folding the second 50 and first 44 edge tabs.

While certain exemplary embodiments have been described above and shown in the accompanying drawings, it is to be understood that the embodiments are merely illustrative of, and not restrictive on the broad invention. It also being understood that this invention should not be limited to the specific constructions and arrangements shown and described, since various other modifications may occur to persons having ordinary skill in the art.

What is claimed is:

1. An asphalt composition ridge cover having a centerline, comprising:

an essentially rectangular sheet having a first end, a second end, a pair of edges, a first face and a second face;

a center portion defined by that portion of said sheet between a pair of first fold locating means, said first fold locating means extending essentially parallel to the centerline;

a pair of first edge tabs defined by that portion of said sheet between said pair of first fold locating means and a pair of second fold locating means, said second fold locating means extending essentially parallel to the centerline;

a pair of second edge tabs defined by that portion of said sheet between said second fold locating means and said sheet edges, said pair of second edge tabs extending from said first end to a pair of third fold locating means; and, a pair of third edge tabs defined by that portion of said sheet between said pair of second fold locating means and said sheet edges, and between said pair of third fold locating means and said second end.

2. The asphalt composition ridge cover as recited in claim 1, wherein each said fold locating means comprises a crease in said sheet.

3. The asphalt composition ridge cover as recited in claim 2, wherein each said fold locating means comprises a pair of spaced apart creases.

4. The asphalt composition ridge cover as recited in claim 1, further comprising a pair of notches extending from said second end along said pair of first locating means.

5. The asphalt composition ridge cover as recited in claim 1, further comprising a pair of slits extending from said second end along said pair of second fold locating means, said slits separate said third edge tabs from said first edge tabs.

6. The asphalt composition ridge cover as recited in claim 1, further comprising;

a pair of fourth edge tabs defined by that portion of said sheet between said pair of second fold locating means and said sheet edges, and between a pair of fourth fold locating means and said second end.

7. The asphalt composition ridge cover as recited in claim 6, wherein said fourth fold locating means comprises a crease in said sheet.

8. The asphalt composition ridge cover as recited in claim 6, further comprising a pair of slits extending from said second end along said pair of second fold locating means, said slits separate said third edge tabs and said fourth edge tabs from said first edge tabs.

9. The asphalt composition ridge cover as recited in claim 8, further comprising a pair of notches extending from said second end along said pair of first locating means.

10. A method of forming an asphalt composition ridge cover, comprising the steps of:

providing;

a) an essentially rectangular sheet having a first end, a second end, a pair of edges, a first face and a second face;

b) a center portion defined by that portion of said sheet between a pair of first fold locating means, said first fold locating means extending essentially parallel to the centerline;

c) a pair of first edge tabs defined by that portion of said sheet between said pair of first fold locating means and a pair of second fold locating means, said second fold locating means extending essentially parallel to the centerline;

d) a pair of second edge tabs defined by that portion of said sheet between said second fold locating means and said sheet edges, said pair of second edge tabs extending from said first end to a pair of third fold locating means;

e) a pair of third edge tabs defined by that portion of said sheet between said pair of second fold locating means and said sheet edges, and between said pair of third fold locating means and said second end;

folding said pair of third edge tabs about said pair of third fold locating means, such that said first face of said third edge tabs are facing said first face of said second edge tabs;

folding said folded pair of third edge tabs and said pair of second edge tabs about said pair of second fold locating means, such that said second face of said third edge tabs are facing said first face of said first edge tab; and folding said folded second edge tabs and said first edge tabs about said first fold locating means, such that said second face of said second edge tabs and said first face of said first edge tabs are facing said first face of said center portion.

11. The method as recited in claim 10, wherein said first face of said third edge tabs are attached to said first face of said second edge tabs, said second face of said third edge tabs are attached to said first face of said first edge tabs, said first face of said first edge tabs and said second face of said second edge tabs are attached to said first face of said center portion.

12. The method as recited in claim 11, wherein said first face of said third edge tabs are attached to said first face of said second edge tabs by a pair of adhesive lines running essentially parallel with said second fold locating means approximately at the center of said second and third edge tabs, said second face of said third edge tabs are attached to said first face of said first edge tabs by a pair of adhesive lines running essentially parallel with said first fold locating means approximately at the center of said first edge tabs, said second face of said second edge tabs and said first face of said first edge tabs are attached to said first face of said center portion by a pair of adhesive lines running essentially parallel with the centerline approximately one-half the distance between the centerline and said first locating means.

13. The method as recited in claim 10, wherein said sheet has a pair of notches extending from said second end along said pair of first fold locating means.

14. The method as recited in claim 10, wherein said sheet has a pair of slits extending from said second end along said pair of second fold locating means, said slits separate said third edge tabs from said first edge tabs.

15. A method of forming an asphalt composition ridge cover, comprising the steps of:

providing;

a) an essentially rectangular sheet having a first end, a second end, a pair of edges, a first face and a second face;

b) a center portion defined by that portion of said sheet between a pair of first fold locating means, said first fold locating means extending essentially parallel to the centerline;

c) a pair of first edge tabs defined by that portion of said sheet between said pair of first fold locating means and a pair of second fold locating means, said second fold locating means extending essentially parallel to the centerline;

d) a pair of second edge tabs defined by that portion of said sheet between said second fold locating means and said sheet edges, said pair of second edge tabs extending from said first end to a pair of third fold locating means;

e) a pair of third edge tabs defined by that portion of said sheet between said pair of second fold locating means and said sheet edges, and between said pair of third fold locating means and a pair of fourth locating means;

f) a pair of fourth edge tabs defined by that portion of said sheet between said pair of second fold locating means and said sheet edges, and between said pair of fourth fold locating means and said second end;

folding said pair of fourth edge tabs about said pair of fourth fold locating means, such that said first face of said fourth edge tabs face said first face of said third edge tabs;

folding said folded pair of fourth edge tabs and said pair of third edge tabs about said pair of third fold locating means such that said second face of said fourth edge tabs and said first face of said third edge tabs are facing said first face of said second edge tabs;

folding said folded pair of third edge tabs and said pair of second edge tabs about said pair of second fold locating means, such that said second face of said third edge tabs is facing said first face of said first edge tab; and folding said folded second edge tabs and said first edge tabs about said first fold locating means, such that said second face of said second edge tabs and said first face of said first edge tabs are facing said first face of said center portion.

16. The method as recited in claim 15, wherein said first face of said fourth edge tabs are attached to said first face of said third edge tabs, said second face of said fourth edge tabs and said first face of said third edge tabs are attached to said first face of said second edge tabs, said second face of said third edge tabs are attached to said first face of said second edge tabs, said first face of said first edge tabs and said second face of said second edge tabs are attached to said first face of said center portion.

17. The method as recited in claim 16, wherein said first face of said fourth edge tabs are attached to said first face of said third edge tabs, and said second face of said fourth edge tabs and said first face of said third edge tabs are attached to said first face of said second edge tabs, by a pair of adhesive lines running essentially parallel with said second fold locating means approximately at the center of said second, third and fourth edge tabs, said second face of said third edge tabs are attached to said first face of said first edge tabs by a pair of adhesive lines running essentially parallel with said first fold locating means approximately at the center of said first edge tabs, said second face of said second edge tabs and said first face of said first edge tabs are attached to said first face of said center portion by a pair of adhesive lines running essentially parallel with the centerline approximately one-half the distance between the centerline and said first locating means.

18. The method as recited in claim 15, wherein said sheet has a pair of notches extending from said second end along said pair of first fold locating means.

19. The method as recited in claim 15, wherein said sheet has a pair of slits extending from said second end along said pair of second fold locating means, said slits separate said third edge tabs and said fourth edge tabs from said first edge tabs.

20. An asphalt composition ridge cover having a centerline, comprising:

an essentially rectangular sheet having a first end, a second end, a pair of edges, a first face and a second face;

a center portion defined by that portion of said sheet between a pair of first fold locating means, said first fold locating means extending essentially parallel to the centerline;

a pair of first edge tabs defined by that portion of said sheet between said pair of first fold locating means and a pair of second fold locating means, said second fold locating means extending essentially parallel to the centerline; and a pair of second edge tabs defined by that portion of said sheet between said second fold locating means and said sheet edges, said pair of second edge tabs extending from said first end to a pair of third fold locating means;

a pair of third edge tabs defined by that portion of said sheet between said pair of second fold locating means and said sheet edges, and between a pair of fourth fold locating means and said pair of third fold locating means;

a pair of fourth edge tabs defined by that portion of said sheet between said pair of second fold locating means and said sheet edges, and between said pair of fourth fold locating means and said second end;

a pair of notches extending from said second end along said pair of first fold locating means; and a pair of slits extending from said second end along said pair of second fold locating means, said slits separate said third edge tabs and said fourth edge tabs from said first edge tabs.

21. A method of forming an asphalt composition ridge cover, comprising the steps of:

providing;

a) an essentially rectangular sheet having a first end, a second end, a pair of edges, a first face and a second face;

b) a center portion defined by that portion of said sheet between a pair of first fold locating means, said first fold locating means extending essentially parallel to the centerline;

c) a pair of first edge tabs defined by that portion of said sheet between said pair of first fold locating means and a pair of second fold locating means, said second fold locating means extending essentially parallel to the centerline; and d) a pair of second edge tabs defined by that portion of said sheet between said second fold locating means and said sheet edges, said pair of second edge tabs extending from said first end to a pair of third fold locating means;

e) a pair of third edge tabs defined by that portion of said sheet between said pair of second fold locating means and said sheet edges, and between a pair of fourth fold locating means and said pair of third fold locating means;

f) a pair of fourth edge tabs defined by that portion of said sheet between said pair of second fold locating means and said sheet edges, and between said pair of fourth fold locating means and said second end;

g) a pair of notches extending from said second end along said pair of first fold locating means;

h) a pair of slits extending from said second end along said pair of second fold locating means, said slits separate said third edge tabs and said fourth edge tabs from said first edge tabs;

folding said pair of fourth edge tabs about said pair of fourth fold locating means, such that said first face of said fourth edge tabs face said first face of said third edge tabs;

folding said folded pair of fourth edge tabs and said pair of third edge tabs about said pair of third fold locating means such that said second face of said fourth edge tabs and said first face of said third edge tabs are facing said first face of said second edge tabs, said first face of said fourth edge tabs are attached to said first face of said third edge tabs, and said second face of said fourth edge tabs and said first face of said third edge tabs are attached to said first face of said second edge tabs, by a pair of adhesive lines running essentially parallel with said second fold locating means approximately at the center of said second, third and fourth edge tabs;

folding said folded pair of third edge tabs and said pair of second edge tabs about said pair of second fold locating means, such that said second face of said third edge tabs is facing said first face of said first edge tab, said second face of said third edge tabs are attached to said first face of said first edge tabs by a pair of adhesive lines running essentially parallel with said first fold locating means approximately at the center of said first edge tabs; and folding said folded second edge tabs and said first edge tabs about said first fold locating means, such that said second face of said second edge tabs and said first face of said first edge tabs are facing said first face of said center portion, said second face of said second edge tabs and said first face of said first edge tabs are attached to said first face of said center portion by a pair of adhesive lines running essentially parallel with the centerline approximately one-half the distance between the centerline and said first locating means.

* * * * *